US006019155A

United States Patent [19]

Daoud

[11] Patent Number: 6,019,155

[45] Date of Patent: Feb. 1, 2000

[54] EXTENDABLE SURFACE

[75] Inventor: Bassel H. Daoud, Parsippany, N.J.

[73] Assignee: Lucent Technologies, Inc., Murray Hill, N.J.

[21] Appl. No.: 09/064,896

[22] Filed: Apr. 23, 1998

[51] Int. Cl.[7] ..... E04F 10/10

[52] U.S. Cl. ..... 160/134; 160/62; 160/127

[58] Field of Search ..... 160/134, 84.07, 160/44, 127, 197, 202, 211, 223, 216, 62

[56] References Cited

U.S. PATENT DOCUMENTS 2,517,281 8/1950 Brown ..... 160/134 X
2,699,823 1/1955 Zveibil ..... 160/62
2,875,825 3/1959 Soares ..... 160/134 X
3,386,455 6/1968 O'Rear ..... 160/134 X

*Primary Examiner*—David M. Purol
*Attorney, Agent, or Firm*—Synnestvedt & Lechner

[57] ABSTRACT

An extendable surface comprising a plurality of triangular leaves is disclosed. The leaves are arranged one above another and are hingedly mounted at the apex of each leaf for rotational motion between a retracted position in which the leaves are arranged in overlapping relation, to an extended position in which the leaves are adjacent to one another. The leaves have interengaging hooks along their edges which link the leaves together in the extended position and seal the surface, preventing water from leaking through the surface.

21 Claims, 6 Drawing Sheets

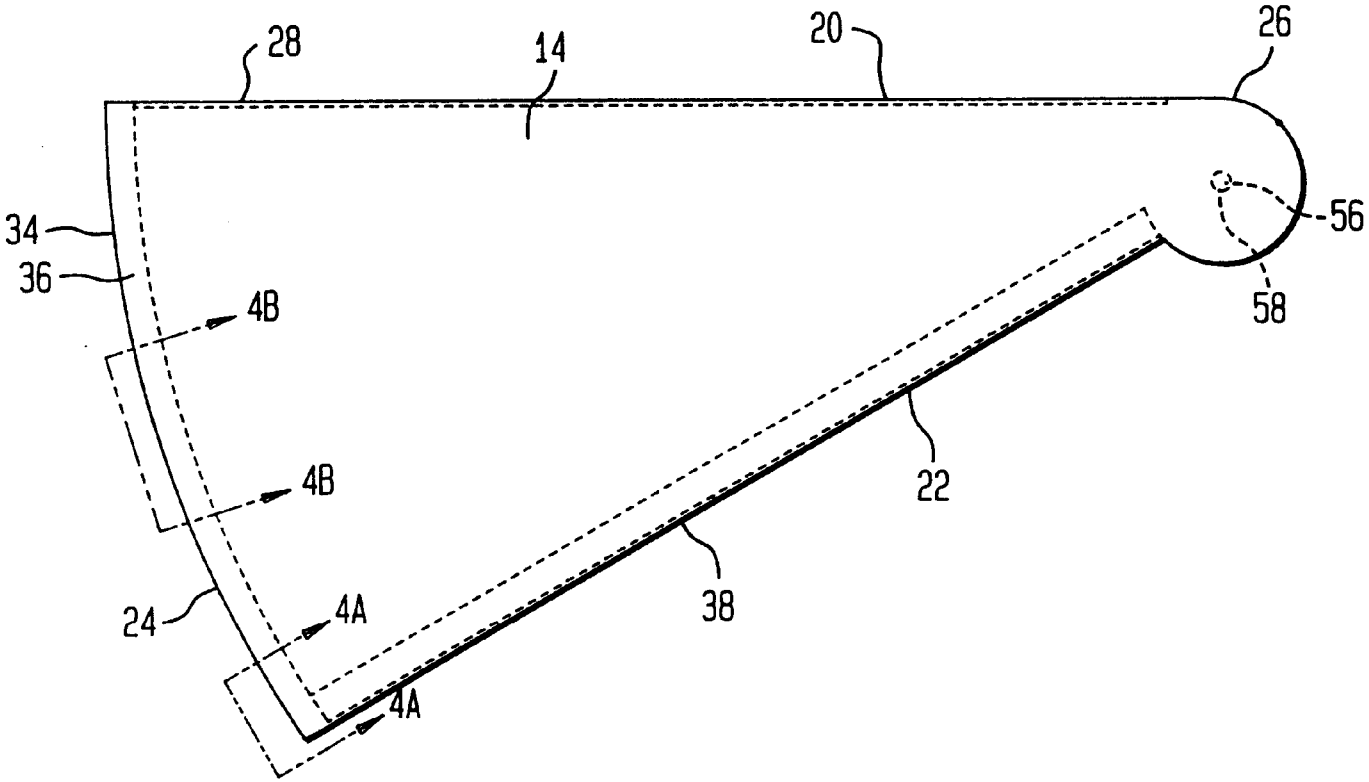
FIG. 4
FIG. 4B
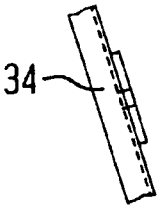
FIG. 4A
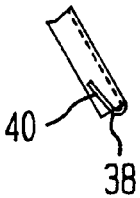

EXTENDABLE SURFACE

FIELD OF THE INVENTION

This invention relates to an extendable surface which can serve as a protective weather shield and more particularly to a surface which can be deployed from a compact, retracted position to an extended position as desired.

BACKGROUND OF INVENTION

Electrical junction boxes such as those used for telecommunications, cable television, control systems and power distribution are often mounted outside where they are constantly exposed to the elements. Such exposure is normally not a problem for the boxes or their contents as the boxes are designed to be weather proof. However, it is often necessary to perform maintenance on or make modifications to the contents of such boxes. For example, to add new lines to a telephone system or to trouble shoot the system for problems, the junction box must be opened and its contents exposed to the weather. If there is rain or snow during servicing, the internal components of the box can be damaged or rendered inoperable if the water is allowed to contact the exposed components. For example, water can cause short circuits in telephone line connectors which disable individual phone lines; it can also cause surge protectors to malfunction and thereby compromise the safety and electrical protection of the entire system.

Currently, technicians servicing junction boxes carry an umbrella which they use to shield themselves and the box when working out of doors during inclement weather. This solution is impractical because the technician typically must hold the umbrella with one hand and work on the box with the other, reducing the efficiency of the technician and increasing fatigue. This solution can be dangerous when the technician must work on a ladder to access the box. Clearly there is a need for an improved means for protecting the contents of an electrical junction box from precipitation when the box is out of doors and being serviced.

SUMMARY AND OBJECTS OF INVENTION

This invention provides an extendable surface which can be mounted above an outdoor junction box containing electrical equipment which is adversely affected by water. The extendable surface is normally stowed in a compact, retracted position and is manually deployed to an extended position when required to shield the contents of the open box from rain, sleet or snow.

The extendable surface comprises a plurality of triangular leaves hingedly mounted one above another for rotation about an axis through the apex of each leaf. In the retracted position the leaves are arranged one atop the other in substantially overlapping relation, and in the extended position the leaves are arranged adjacent to one another to form the extended surface. The leaves are manually rotatable about the apex axis between the retracted and extended positions.

Each leaf has an inside edge and an outside edge terminating at the apex of each leaf. The inside edges of the leaves comprise those edges which are closest to the surface or structure on which the extendable surface is mounted when the extendable surface is in the retracted position. The outside edges on each leaf are arranged respectively opposite the inside edges on each leaf.

The plurality of leaves includes a first leaf and a last leaf, and may also comprise one or more intermediate leaves arranged in between the first and last leaves. The first leaf has a hook on its outside edge, and the last leaf has a hook on its inside edge. Intermediate leaves, if present, will have hooks on both their inside and outside edges. The hooks are interengagable with one another, the outer hook of one leaf interengaging the inner hook of the leaf arranged below it when the leaves are rotated from the retracted to the extended position. The hooks cooperate to keep the leaves arranged adjacent to one another when the leaves are rotated into the extended position.

Preferably, the first leaf is arranged uppermost of the leaves and has a mounting flange extending from its inside edge. The mounting flange is arranged at a right angle to the plane of the first leaf and is used to mount the extendable surface onto a fixed structure. The last leaf is arranged lowermost of the leaves and has a handle extending from its outer edge, the handle affording a place for manually gripping the last leaf in order to rotate the leaves between the retracted and extended positions.

To prevent water from accumulating on the extendable surface at least one leaf, and preferably all of the leaves, have a lip positioned on the third edge extending between the inside and outside edges. The lip comprises a surface segment which extends at an angle downwardly from the plane of the leaves and allows water to run off the extendable surface.

To prevent water from leaking through the extendable surface when the surface is in the extended position the hooks on each leaf are configured as continuous curved extensions of the edge on which each hook is positioned. Each hook is preferably completed by reverse bends which causes each terminal edge portion to project substantially parallel to the plane of its leaf. The hook on the outside edge of each leaf is curved downwardly toward the leaf arranged immediately below while the hook on the inside edge of each leaf is curved upwardly toward the leaf immediately above. In the extended position a hook on the outside edge of a leaf interengages a respective hook on the inside edge of the leaf below it. This configuration of interengaging hooks forms a natural seal along the edges of the leaves which forces water flowing over the surface to cascade over the downwardly curved hook of a leaf without leaking through the joint between the leaves.

It is an object of this invention to provide an extendable surface useable as a shield to protect water sensitive items.

It is an object of this invention to provide an extendable surface which is movable from a compact retracted position into an extended position.

It is yet another object of this invention to provide an extendable surface which can be inexpensively fabricated from common materials.

These and other objects of the invention will become apparent from a consideration of the drawings and the detailed description of the preferred embodiment which follows.

BRIEF DESCRIPTION OF THE DRAWINGS

FIG. 4 shows a plan view of a first leaf with various details hidden from view being shown by dotted lines;

FIG. 4A shows a side view of a portion of FIG. 4 taken along lines 4A—4A;

FIG. 4B shows a side view of a portion of FIG. 4 taken along lines 4B—4B;

DETAILED DESCRIPTION OF THE PREFERRED EMBODIMENT

Figure 1:
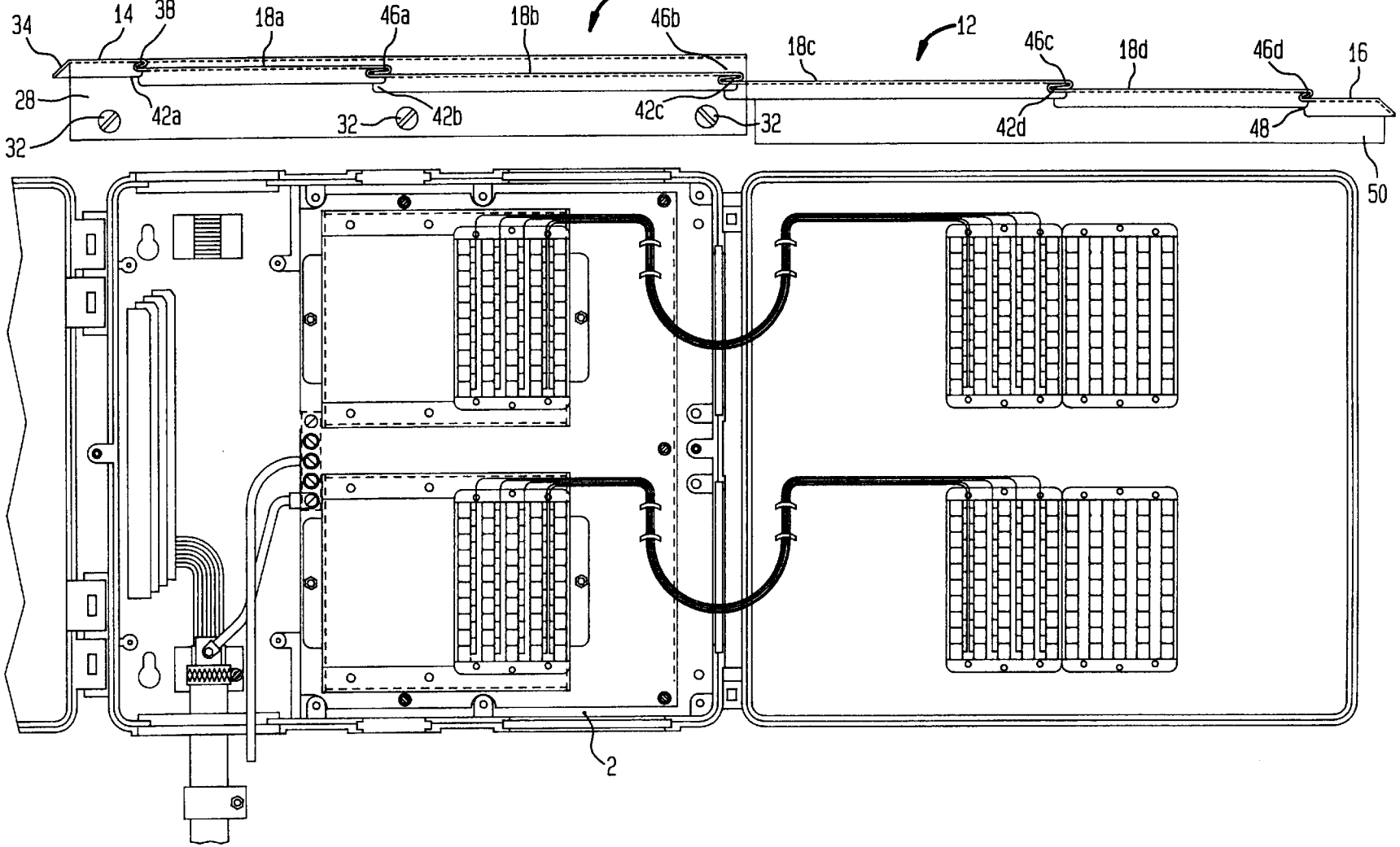
FIG. 1 shows a front elevational view of an extendable surface in the extended position and mounted above an open building entry protection unit (BEP) type junction box.
Figure 2:
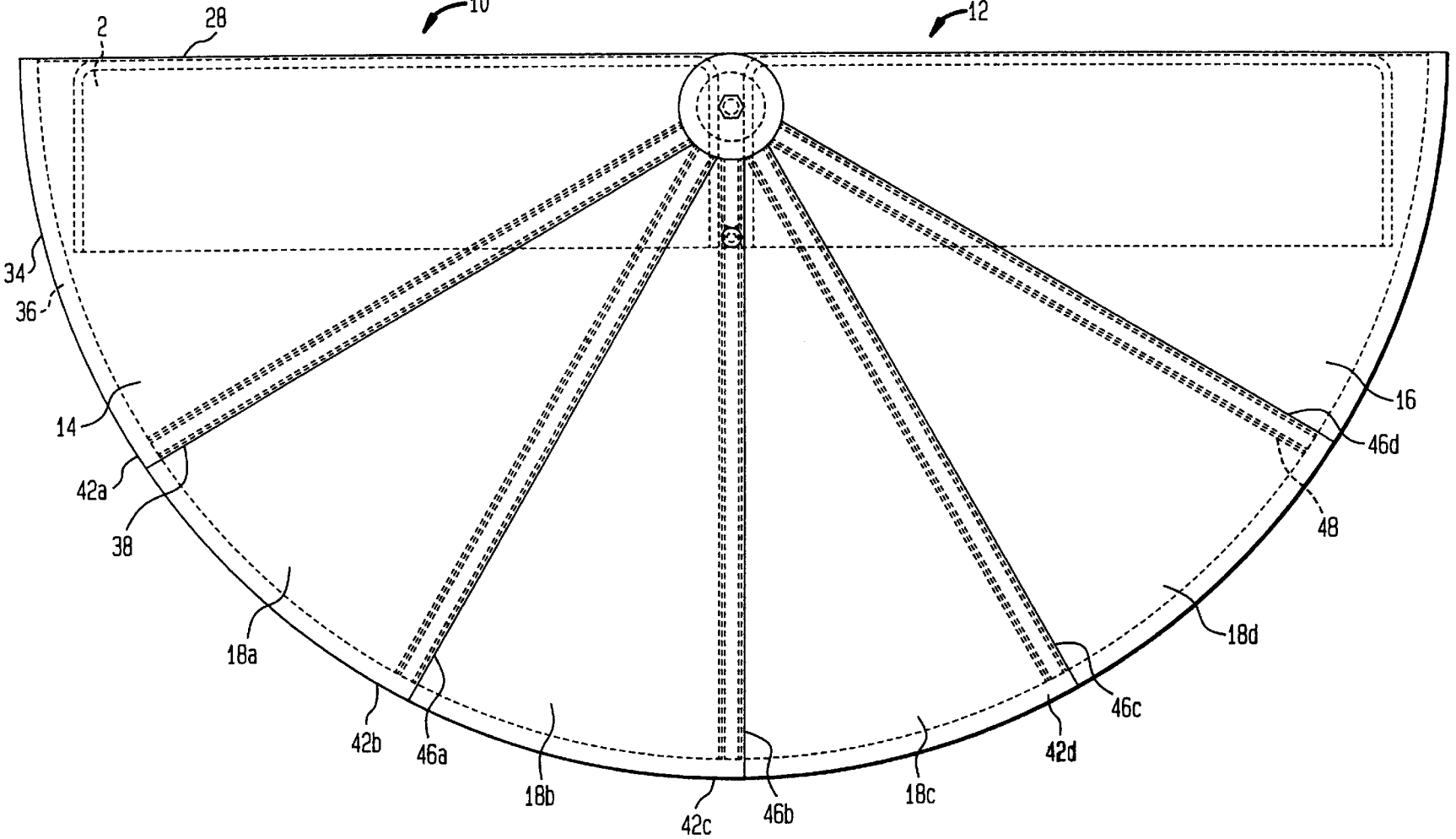
FIG. 2 shows a plan view of an extendable surface in the extended position mounted above an open BEP, the BEP and various details of the extendable surface hidden from view being shown by dotted lines.

FIGS. 1 and 2 show an extendable surface 10 according to the invention mounted above a building entry protection unit (BEP) 2. The BEP 2 is shown in the open position as it would be accessed by a technician for servicing.

BEPs are commonly used to connect the telephone lines within a building to the external lines of a regional telephone system. BEPs typically contain wiring blocks, connectors, and electrical surge protection equipment, all of which can be adversely affected by water. Although extendable surface 10 is shown in conjunction with a BEP, it is understood that the invention is not limited to this use and that extendable surface 10 could be used to protect almost any type of device requiring shielding from the elements.

Figure 7:
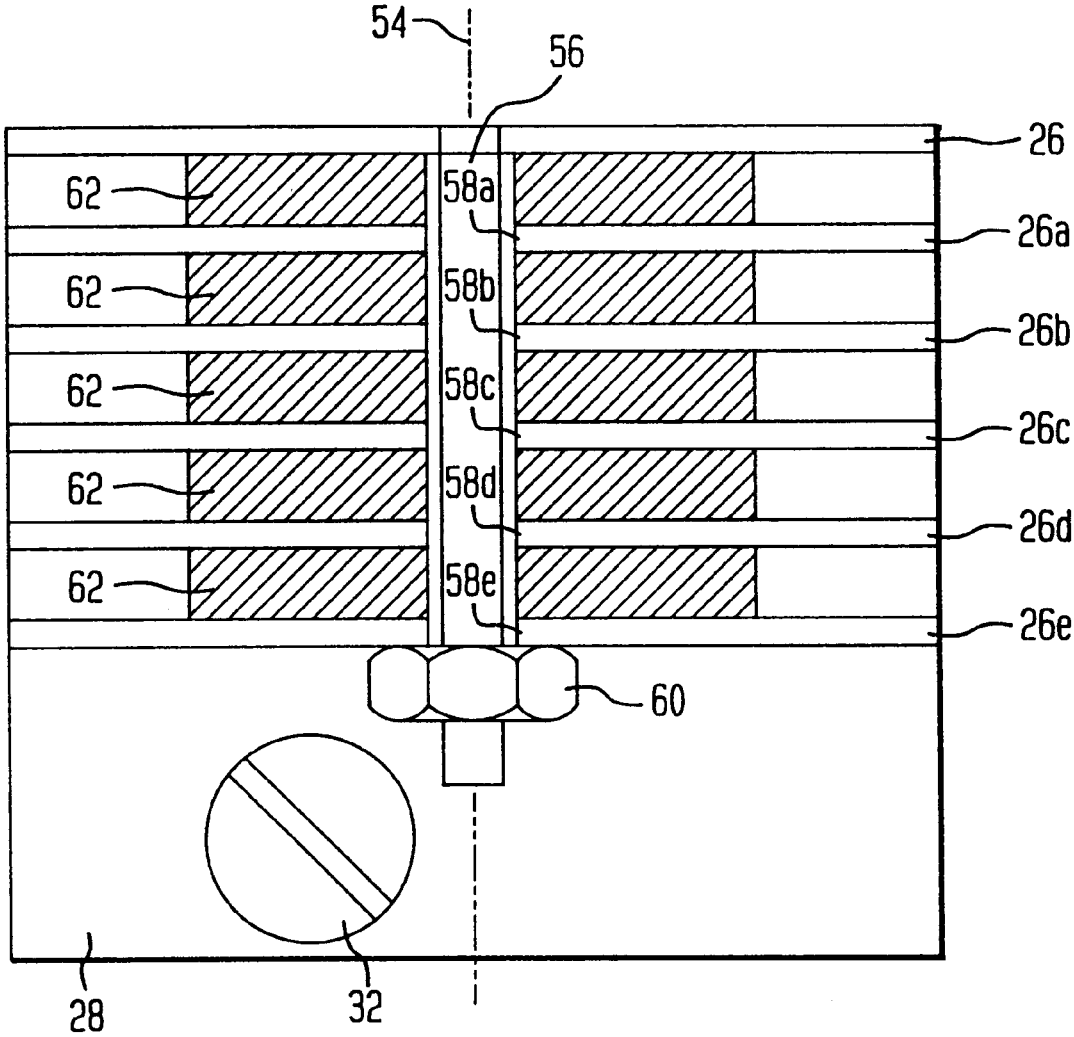
FIG. 7 shows a partial sectional view taken along lines 7—7 of FIG. 3.

Extendable surface 10 comprises a plurality of leaves 12 including a first leaf 14, a last leaf 16, and one or more intermediate leaves 18*a*–18*d*. FIG. 4 shows first leaf 14 in detail, and as is common to all of the leaves, first leaf 14 has a triangular shape defined by an inside edge 20, an outside edge 22 arranged opposite inside edge 20, and a third radial edge 24 extending between the inside and outside edges 20, 22. Inside edge 20 and of side edge 22 terminate at an apex 26. As seen in FIG. 7, he apexes 26 and 26*a*–26*e* of the leaves 26*a*–26*e* and 26*a*–26*e* provide the mounting ponts whereby the leaves are hingedly connected to each other as described in detail below.

As shown in FIGS. 1 and 4,the extended surface 10 is preferably mounted to a structure, such as a wall, by means of the first leaf 14. A flange 28 is provided for this purpose. The flange 28 (FIG. 1) extends at aright angle to first leaf 14 and provides a surface for mounting screws 32 to engage for mounting to a structure in position above the BEP 2 for example.

FIG. 1 illustrates a downwardly depending lip 34 slopes from the edge surface 24 of each leaf. Lip 34 helps guide water from extendable surface 10 and thereby prevents water from pooling on the surface or accumulating as droplets on its underside as the water runs off of the edge of the leaf.

As seen in FIGS. 1 and 4, outside edge 22 has a hook 38 positioned thereon which is interengagable with a cooperating hook on the inside edge of another leaf, for example leaf 18*a* (seen in FIGS. 1 and 2), arranged adjacent to first leaf 14. Although hook 38 could take many forms it is preferred that the hook comprise a continuous curved extension 40 of outside edge 22 in the form of a "C" shape as best illustrated in FIG. 4A. A continuous hook along the edges of the leaves forms a natural seal between each leaf which, when properly oriented as described below, will prevent water from leaking through the extendable surface and into the open BEP unit or other water sensitive component.

Figure 5:
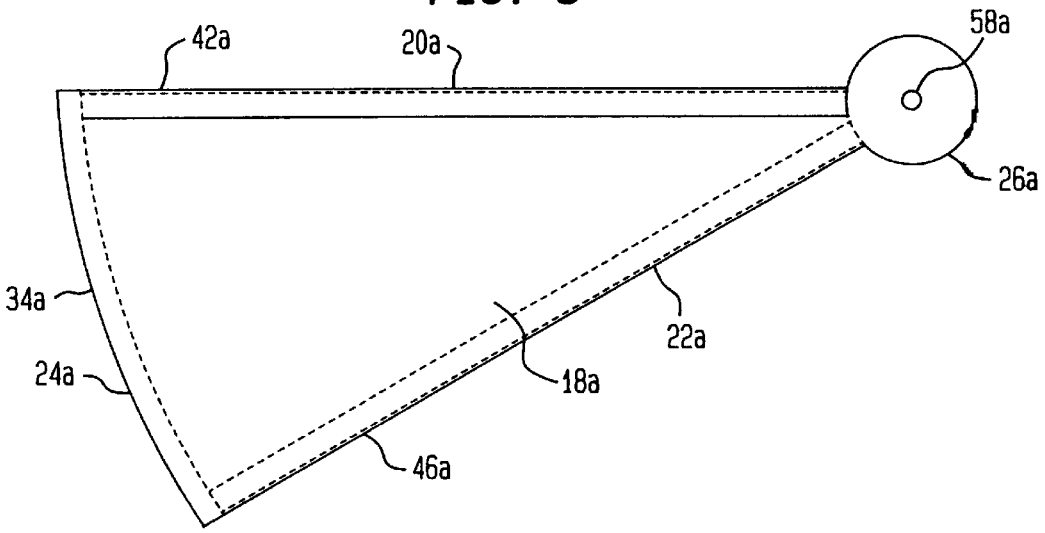
FIG. 5 shows a plan view of an intermediate leaf with various details hidden from view being shown by dotted lines.

FIG. 5 shows an intermediate leaf 18*a*. As the intermediate leaves 18*a*–18*d* are essentially identical and similar in shape to leaves 14 and 16, the following description of leaf 18*a* applies to all of the intermediate leaves. Intermediate leaf 18*a* is triangular in shape and has an inside edge 20*a* and an outside edge 22*a* which are oppositely disposed on the leaf and terminate in an apex 26*a*. A third or radial edge 24*a* extends between the inside and outside edges. A lip 34*a*, like lip 34 in FIG. 4B, is preferably disposed along edge 24*a*. A cooperating hook 42*a* is disposed on inside edge 20*a*. Cooperating hook 42*a* is substantially like hook 38, except that it is curved opposite to it so that the two hooks will interengage when the extendable surface 10 is in its extended position as seen in FIG. 1.

A second hook 46*a* disposed along outside edge 22*a* is curved to cooperate with the hook on the next adjacent leaf 18*b* in the same way as hooks 38 and 42*a* cooperate.

As best illustrated in FIG. 1, first leaf 14 is preferably arranged uppermost of all the leaves and has its hook 38 curved downwardly, while the subsequent intermediate leaves 18*a*–18*d* have hooks which curve alternately upwardly and downwardly to interengage the cooperating hooks on an adjacent leaf when the leaves are relatively extended. By curving the hook on first leaf 14 downward, a pattern is established wherein all of the hooks on the outside edges on all of the successive leaves are also curved downwardly. This configuration is preferred because the hooks, when engaged one with another, form a natural seal which is proof against water because the water tends to cascade over the outside edge of each leaf and does not readily travel up the curved hook of the inside edge to leak through the extendable surface.

Figure 6:
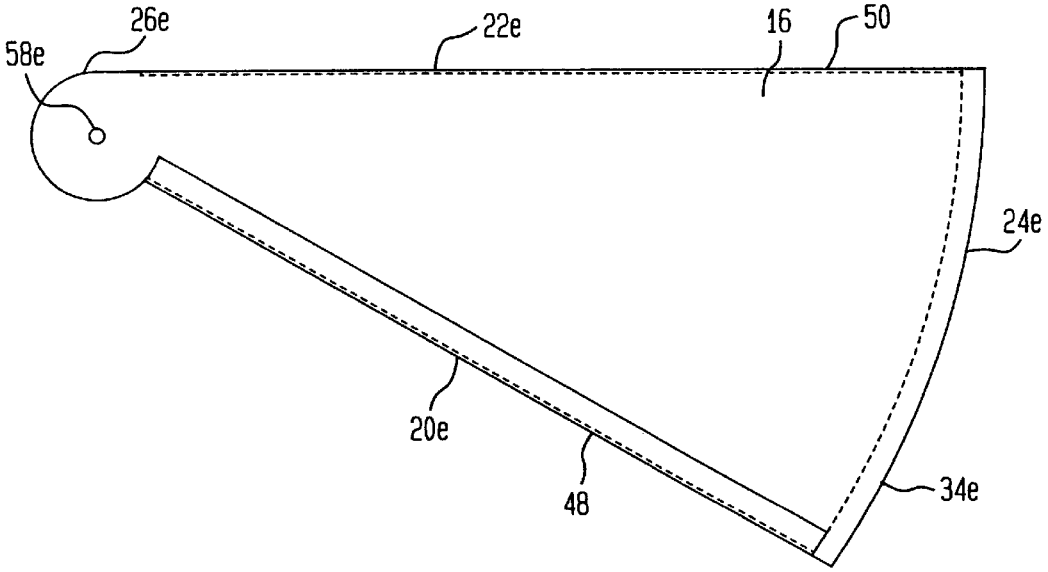
FIG. 6 shows a plan view of a last leaf with various details hidden from view being shown by dotted lines.

As seen in FIG. 6, last leaf 16 is like leaf 14 with the exception of upwardly curled hook 48 disposed on the inside edge 20*e* and a handle 50 disposed on outside edge 22*e*. Hook 48 has the same basic shape as hook 38, shown in FIG. 4A, except for the upward curvature noted.

The leaves are hingedly attached to each other at the apexes 26, and 26*a*–26*e*, about a common axis of rotation 54 best illustrated in FIG. 7. Preferably, axis 54 is perpendicular to the plane of the extendable surface. An axle, in the form of a self clinching stud 56 physically defines the axis 54 and provides the mounting for rotatably fastening the hinges at the apexes. Stud 56 is inserted into an aperture 58 in the apex 26 of first leaf 14 whereupon the stud embeds itself flush with the surface of the apex and extends perpendicularly therefrom. Apexes for the intermediate leaves also have apertures denoted as 58*a*–58*d* (FIGS. 5 and 7), and last leaf 16 has a similar aperture 58*e* (FIG. 6) sized to accept stud 56. Stud 56 preferably has a round cross section which allows the leaves to rotate freely on the stud. The stud extends from apex 26 of first leaf 14, and the leaves are retained to the stud by means of a locknut 60. Washers 62 are inserted between the apexes to reduce friction between the leaves as they rotate relative to one another. Preferably the leaves are fabricated from sheet metal and the washers are made of a plastic material, although the invention is not limited to these materials.

Figure 3:
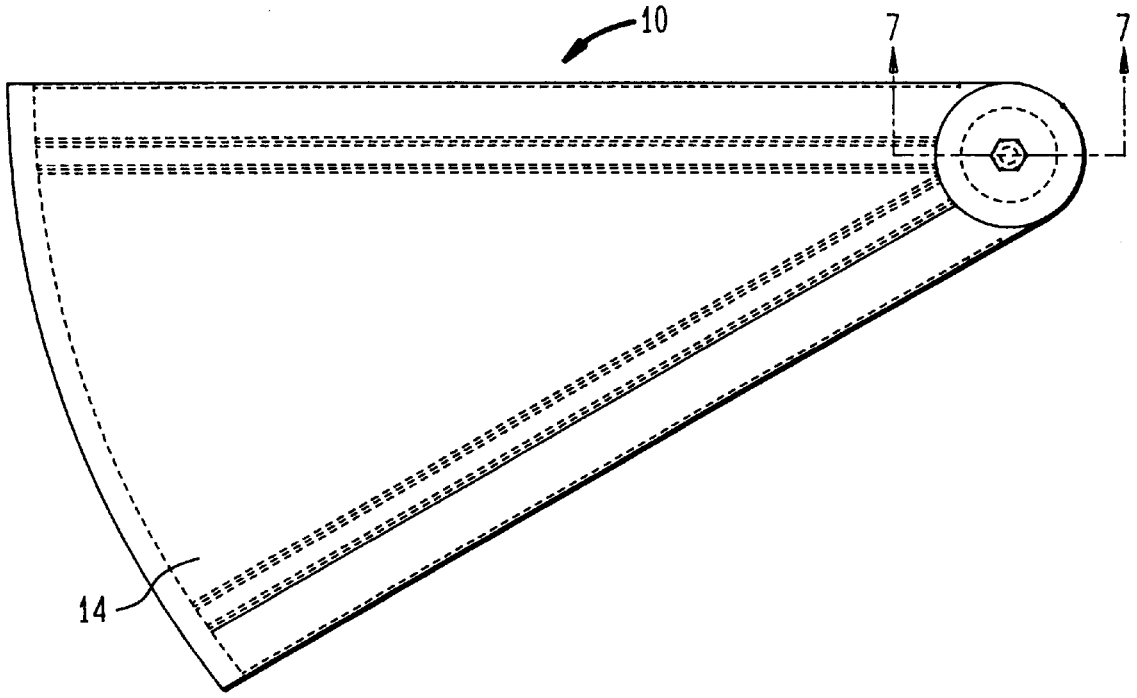
FIG. 3 shows a plan view of an extendable surface in the retracted position, with various details hidden from view being shown by dotted lines.

In use, the extendable surface according to the invention would be mounted above a BEP unit as seen in FIG. 1, or some other device. The BEP unit may be mounted on the outside wall of a building and provide for connection of the telephone lines in the building to the regional telephone system's lines. A technician performing a task on the building telephone system, for example adding a phone line or trouble shooting for a malfunction, can shield the BEP while working during periods of inclement weather by grasping the handle 50 and moving the leaves from the retracted position seen in FIG. 3, to the extended position seen in FIGS. 1 and 2. As the technician moves last leaf 16 from an overlapping position with leaf 18*d*, hook 48 on leaf 16 engages cooperating hook 46*d* on intermediate leaf 18*d*. As the last leaf is moved further it pulls intermediate leaf 18*d* from overlapping relation with intermediate leaf 18*c*, whereupon cooperating hooks 42*d* and 46*c* on those leaves interengage. Further movement continues to draw subsequent leaves along as the respective hooks interengage until the extendable surface 10 is fully deployed. The technician may then open BEP 2 which will be shielded by extendable surface 10 as shown in FIG. 1.

The extendable surface according to the invention provides a simple yet effective means for shielding sensitive components from the adverse effects of the elements. It is inexpensive to manufacture, reliable in operation, and versatile in its potential uses.

Although the extendable surface has been described as a weather shield, it is not limited to this use. The extendable surface could also function as a table when mounted beneath a BEP unit to provide a work surface upon which to place tools and small parts. When used as a table, lips 34 would preferably be turned upward to prevent tools and components from rolling off of the surface.

What is claimed is:

1. An extendable surface, comprising:

a plurality of triangular leaves, each of said leaves having an apex, an inside edge and an outside edge terminating at said apex, said leaves being arranged one above another and connected hingedly to one another for rotation about an axis passing through the apex of each leaf, said plurality of leaves including a first leaf and a last leaf, said first leaf having an outer hook positioned on said outside edge, said last leaf having an inner hook positioned on said inside edge, said leaves being relatively rotatable between a retracted position wherein said leaves are arranged in substantially overlapping relation and an extended position wherein said leaves are substantially adjacent one another, said inner and outer hooks being interengagable and being interengaged when the leaves are moved to said extended position, said extendable surface being mounted above an electrical junction box to substantially shield the junction box from above when said extendable surface is in said extended position.

2. An extendable surface according to claim 1, wherein said plurality of leaves further comprises an intermediate leaf positioned in between said first and said last leaves, said intermediate leaf having a first hook on said inside edge and a second hook on said outside edge, said first hook being interengagable with said outer hook and said second hook being interengagable with said inner hook, said first hook interengaging said outer hook and said second hook interengaging said inner hook when said leaves are in said extended position.

3. An extendable surface according to claim 2, wherein each of said hooks comprises an extension of said edge upon which said hook is positioned, each said extension projecting away from the plane of each said leaf.

4. An extendable surface according to claim 2, wherein each of said hooks comprises a continuous curved extension of said edge upon which said hook is positioned, said extensions on said inside edges being curved in an opposite direction from said extensions on said outside edges, said extensions interengaging one another when said leaves are in said extended position.

5. An extendable surface according to claim 4, wherein said first leaf is arranged above said intermediate leaf and has an outer hook which curves downwardly toward said intermediate leaf.

6. An extendable surface according to claim 1, wherein said leaves are formed from sheet metal.

7. An extendable surface according to claim 1, wherein each leaf has an aperture positioned in said apex, said extendable surface further comprising an elongated self clinching stud having a cylindrical cross section, said stud being oriented perpendicularly to said leaves and passing through said apertures, said leaves rotating on said stud between said extended and retracted positions.

8. An extendable surface according to claim 1, wherein said first leaf further comprises a flange extending from said inside edge, said flange comprising a segment extending at a right angle to said first leaf for mounting of said extendable surface.

9. An extendable surface according to claim 1, wherein said last leaf further comprises a handle positioned on said outside edge, said handle comprising a surface portion extending at an angle from the plane of said last leaf for facilitating manual movement of said extendable surface between said retracted and extended positions.

10. An extendable surface according to claim 1, wherein each said leaf further comprises a third edge extending between said inside and outside edges, a lip being arranged along each said third edge, said lip comprising a surface segment oriented downwardly at an angle to the plane of each said leaf.

11. An extendable surface according to claim 1, wherein said junction box comprises a BEP unit.

12. An extendable surface, comprising:

a plurality of triangular leaves, each leaf having an apex and inside and outside edges oppositely disposed and terminating at said apex, said leaves being arranged one above another and hingedly attached to one another at said apexes for rotational motion about an axis through said apexes from a retracted position wherein said leaves are arranged in a substantially overlapping relationship, to an extended position wherein said leaves are arranged substantially adjacent to one another, said plurality of leaves comprising a first leaf, a last leaf, and at least one intermediate leaf positioned in between said first and last leaves, said first leaf having a hook positioned on said outside edge, said intermediate leaf having a cooperating hook positioned on said inside edge for engaging said hook on said first leaf when said leaves are in said extended position, said intermediate leaf also having another hook positioned on said outside edge, said last leaf having a second cooperating hook positioned on said inside edge for engaging said other hook on said intermediate leaf when said leaves are in said extended position, said extendable surface being mounted above an electrical junction box and substantially shielding said junction box from above when said extendable surface is in said extended position.

13. An extendable surface according to claim 12, wherein said leaves are made of sheet metal.

14. An extendable surface according to claim 12, wherein each of said hooks comprises a continuous curved extension of said edge upon which said hook is positioned.

15. An extendable surface according to claim 14, wherein said curved extension has a "C" shape.

16. An extendable surface according to claim 12, wherein each leaf further comprises a radial edge extending between said inside and outside edges and at least one leaf has a lip extending from said radial edge, said lip comprising a surface portion oriented at an angle to the plane of said one leaf.

17. An extendable surface according to claim 12, wherein said first leaf is positioned above said intermediate leaf and said intermediate leaf is positioned above said last leaf, said hook being curved downwardly toward said intermediate leaf, said cooperating hook being curved upwardly toward said first leaf for interengaging said hook, said other hook being curved downwardly toward said last leaf, said second cooperating hook being curved upwardly toward said intermediate leaf for interengaging said other hook, said hooks being respectively interengaged when said extendable surface is in said extended position to form a water resistant seal between each leaf.

18. An extendable surface according to claim 12, further comprising an elongated self clinching stud having a circular cross section, said stud passing substantially perpendicular through the apex of each leaf, said leaves rotating on said stud between said retracted and extended positions.

19. An extendable surface according to claim 12, wherein said first leaf has a flange extending at a right angle from said inside edge, said flange for mounting of said extendable surface.

20. An extendable surface according to claim 12, wherein said last leaf has a handle positioned on said outside edge, said handle comprising a surface portion extending angularly from the plane of said last leaf, said handle for facilitating manual grasping of said last leaf for moving said extendable surface between said retracted and extended positions.

21. An extendable surface according to claim 12, wherein said junction box comprises a BEP unit.

* * * * *